US006368675B1

(12) United States Patent
Louks et al.

(10) Patent No.: US 6,368,675 B1
(45) **Date of Patent: *Apr. 9, 2002**

(54) ELECTROSTATICALLY ASSISTED COATING METHOD AND APPARATUS WITH FOCUSED ELECTRODE FIELD

(75) Inventors: John W. Louks, Hudson, WI (US); Sharon Wang, Woodbury; Luther E. Erickson, Grant, both of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/544,592

(22) Filed: Apr. 6, 2000

(51) Int. Cl.[7] ..... B05D 1/04; B05D 1/30

(52) U.S. Cl. ..... 427/472; 427/533; 427/600; 427/420

(58) Field of Search ..... 427/209, 326, 427/471–72, 420, 533, 536, 538, 600; 118/410, 621, 626–27, 636, 638, DIG. 4; 361/212, 214

(56) References Cited

U.S. PATENT DOCUMENTS

| | | | |
|---|---|---|---|
| 878,273 | A | 2/1908 | Chapman |
| 2,052,131 | A | 8/1936 | Chappell |
| 2,559,225 | A | 7/1951 | Ransburg |
| 2,685,536 | A | 8/1954 | Starkey et al. |
| 2,952,559 | A | 9/1960 | Nadeau |
| 3,196,063 | A | 7/1965 | Paquin et al. |
| 3,206,323 | A | 9/1965 | Miller et al. |

(List continued on next page.)

FOREIGN PATENT DOCUMENTS

| | | | |
|---|---|---|---|
| CA | 851087 | A | 3/1970 |
| DE | 33 41 415 | A1 | 5/1984 |
| EP | 0 055 985 | | 7/1982 |
| EP | 0 285 794 | B1 | 9/1991 |
| EP | 0 530 752 | A1 | 3/1993 |
| EP | 0 567 074 | | 10/1993 |
| EP | 0 728 532 | A1 | 8/1996 |
| EP | 0 762 810 | A1 | 3/1997 |
| FR | 2 296 958 | | 7/1976 |
| GB | 1166500 | | 10/1969 |
| GB | 1 487 307 | | 9/1977 |
| GB | 2324054 | | 10/1998 |
| JP | 04627423 | | 8/1971 |
| JP | 01069324 | | 3/1989 |
| JP | 01222923 | | 9/1989 |
| JP | 03053498 | | 3/1991 |
| JP | 04028524 | | 1/1992 |
| JP | 04070312 | | 3/1992 |
| JP | 04077230 | | 3/1992 |
| JP | 04083627 | | 3/1992 |
| JP | 05286019 | | 11/1993 |
| JP | 08064384 | | 3/1996 |
| JP | 09001044 | | 1/1997 |
| WO | WO 89/05477 | | 6/1989 |
| WO | WO 92/11095 | | 7/1992 |
| WO | WO 92/11572 | | 7/1992 |
| WO | WO 92/12612 | | 7/1992 |
| WO | WO 96/09124 | | 3/1996 |

*Primary Examiner*—Fred J. Parker
(74) *Attorney, Agent, or Firm*—Brian E. Szymanski

(57) ABSTRACT

A system for applying a fluid coating onto a substrate includes forming a fluid wetting line by introducing a stream of fluid onto a first side of the substrate along a laterally disposed fluid-web contact area. An electrical force is created on the fluid from an effective electrical field originating from a location on the second side of the substrate and at a location substantially at and downstream of the fluid contact area. The electrical field can be generated in a highly effective manner relative to the coating fluid by a sharply defined electrode on the second side of the substrate. Ultrasonics combined with electrostatic fields further enhances coating process conditions and coating uniformity.

16 Claims, 7 Drawing Sheets

U.S. PATENT DOCUMENTS 3,223,757 A 12/1965 Owens et al.
3,268,766 A 8/1966 Amos et al.
3,335,026 A 8/1967 Geest et al.
3,363,108 A 1/1968 Spurr et al.
3,462,286 A 8/1969 Geest et al.
3,470,274 A 9/1969 Sandiford et al.
3,470,417 A 9/1969 Gibbons et al.
3,474,292 A 10/1969 Carter
3,489,082 A 1/1970 Morris et al.
3,531,314 A 9/1970 Kerr et al.
3,549,406 A 12/1970 Ambusk
3,566,110 A 2/1971 Henderson et al.
3,619,615 A 11/1971 Fish
3,652,897 A 3/1972 Iosue et al.
3,670,203 A 6/1972 Whitmore, Jr. et al.
3,671,806 A 6/1972 Whitmore et al.
3,697,303 A 10/1972 Busch et al.
3,702,258 A 11/1972 Gibbons et al.
3,711,312 A 1/1973 Yoshida et al.
3,716,755 A 2/1973 Marx
3,717,791 A 2/1973 Heyl et al.
3,729,648 A 4/1973 Kerr
3,730,753 A 5/1973 Kerr
3,757,163 A 9/1973 Gibbons et al.
3,757,164 A 9/1973 Binkowski
3,787,706 A 1/1974 Geest
3,790,854 A 2/1974 Dryczynski et al.
3,818,545 A 6/1974 Olson et al.
3,871,980 A 3/1975 Butcher
3,887,843 A 6/1975 Richardson et al.
3,921,037 A 11/1975 Testone
4,007,576 A 2/1977 Metz
4,012,666 A 3/1977 Schramm et al.
4,027,201 A 5/1977 Bacon et al.
4,110,810 A 8/1978 Moore et al.
4,130,852 A 12/1978 Peffer et al.
4,218,493 A 8/1980 Rarey
4,363,070 A 12/1982 Kisler
4,383,752 A 5/1983 Kisler
4,402,035 A 8/1983 Kisler
4,457,256 A 7/1984 Kisler et al.
4,486,808 A 12/1984 Cardone
4,489,672 A 12/1984 Kisler
4,513,683 A * 4/1985 Kisler
4,517,143 A 5/1985 Kisler
4,676,190 A 6/1987 Spengler
4,729,945 A 3/1988 Anthonsen et al.
4,826,703 A 5/1989 Kisler
4,835,004 A 5/1989 Kawanishi
4,837,045 A * 6/1989 Nakajima
4,990,359 A 2/1991 Knobbe
4,999,733 A 3/1991 Kakuda
5,041,941 A 8/1991 Carter et al.
5,122,386 A 6/1992 Yoshida
5,138,971 A 8/1992 Nakajima et al.
5,290,600 A 3/1994 Ord et al.
5,295,039 A 3/1994 Nakajima et al.
5,331,503 A 7/1994 McGarry et al.
5,336,534 A * 8/1994 Nakajima et al.
5,340,616 A 8/1994 Amano et al.
5,420,743 A 5/1995 Domes
5,432,454 A 7/1995 Durkin
6,171,658 B1 1/2001 Zaretsky et al.

* cited by examiner

ELECTROSTATICALLY ASSISTED COATING METHOD AND APPARATUS WITH FOCUSED ELECTRODE FIELD

TECHNICAL FIELD

This invention relates to an electrostatically assisted coating method and apparatus. More specifically, the invention relates to using electrostatic fields at the point of coating fluid contact with a moving web to achieve improved coating process uniformity.

BACKGROUND OF THE INVENTION

Coating is the process of replacing the gas contacting a substrate, usually a solid surface such as a web, by one or more layers of fluid. A web is a relatively long flexible substrate or sheet of material, such as a plastic film, paper or synthetic paper, or a metal foil, or discrete parts or sheets. The web can be a continuous belt. A coating fluid is functionally useful when applied to the surface of a substrate. Examples of coating fluids are liquids for forming photographic emulsion layers, release layers, priming layers, base layers, protective layers, lubricant layers, magnetic layers, adhesive layers, decorative layers, and coloring layers.

After deposition, a coating can remain a fluid such as in the application of lubricating oil to metal in metal coil processing or the application of chemical reactants to activate or chemically transform a substrate surface. Alternatively, the coating can be dried if it contains a volatile fluid to leave behind a solid coat such as a paint, or can be cured or in some other way solidified to a functional coating such as a release coating to which a pressure-sensitive adhesive will not aggressively stick. Methods of applying coatings are discussed in Cohen, E. D. and Gutoff, E. B., Modern Coating and Drying Teclmology, VCH Publishers, New York 1992 and Satas, D., Web Processing and Converting Technology and Equipment, Van Vorstrand Reinhold Publishing Co., New York 1984.

The object in a precision coating application is typically to uniformly apply a coating fluid onto a substrate. In a web coating process, a moving web passes a coating station where a layer or layers of coating fluid is deposited onto at least one surface of the web. Uniformity of coating fluid application onto the web is affected by many factors, including web speed, web surface characteristics, coating fluid viscosity, coating fluid surface tension, and thickness of coating fluid application onto the web.

Electrostatic coating applications have been used in the printing and photographic areas, where roll and slide coating dominate and lower viscosity conductive fluids are used. Although the electrostatic forces applied to the coating area can delay the onset of entrained air and result in the ability to run at higher web speeds, the electrostatic field that attracts the coating fluid to the web is fairly broad. One known method of applying the electrostatic fields employs precharging the web (applying charges to the web before the coating station). Another known method employs an energized support roll beneath the web at the coating station. Methods of precharging the web include corona wire charging and charged brushes. Methods of energizing a support roll include conductive elevated electrical potential rolls, nonconductive roll surfaces that are precharged, and powered semiconductive rolls. While these methods do deliver electrostatic charges to the coating area, they do not present a highly focused electrostatic field at the coater. For example, for curtain coating with a precharged web, the fluid is attracted to the web and the equilibrium position of the fluid/web contact line (wetting line) is determined by a balance of forces. The electrostatic field pulls the coating fluid to the web and pulls the coating fluid upweb. The motion of the web creates a force which tends to drag the wetting line downweb. Thus, when other process conditions remain constant, higher electrostatic forces or lower line speeds result in the wetting line being drawn upweb. Additionally, if some flow variation exists in the crossweb flow of the coating fluid, the lower flow areas are generally drawn further upweb, and the higher flow areas are generally drawn further downweb. These situations can result in decreased coating thickness uniformity. Also, process stability is less than desired because the fluid contact line (wetting line) is not stable but depends on a number of factors.

There are many patents that describe electrostatically-assisted coating. Some deal with the coating specifics, others with the charging specifics. The following are some representative patents. U.S. Pat. No. 3,052,131 discloses coating an aqueous dispersion using either roll charging or web precharging, U.S. Pat. No. 2,952,559 discloses slide coating emulsions with web precharging, and U.S. Pat. No. 3,206,323 discloses viscous fluid coating with web precharging.

U.S. Pat. No. 4,837,045 teaches using a low surface energy undercoating layer for gelatins with a DC voltage on the backup roller. A coating fluid that can be used with this method include a gelatin, magnetic, lubricant, or adhesive layer of either a water soluble or organic nature. The coating method can include slide, roller bead, spray, extrusion, or curtain coating.

EP 390774 B1 relates to high speed curtain coating of fluids at speeds of at least 250 cm/sec (492 ft/min), using a pre-applied electrostatic charge, and where the ratio of the magnitude of charge (volts) to speed (cm/sec) is at least 1:1.

U.S. Pat. No. 5,609,923 discloses a method of curtain coating a moving support where the maximum practical coating speed is increased. Charge may be applied before the coating point or at the coating point by a backing roller. This patent refers to techniques for generating electrostatic voltage as being well known, suggesting that it is referring to the listed examples of a roll beneath the coating point or previous patents where corona charging occurs before coating. This patent also discloses corona charging. The disclosed technique is to transfer the charge to the web with a corona, roll, or bristle brush before the coating point to set up the electrostatic field on the web before the coating is added.

FIGS. 1 and 2 show known techniques for electrostatically assisting coating applications. In FIG. 1, a web 20 moves longitudinally (in the direction of arrows 22) past a coating station 24. The web 20 has a first major side 26 and a second major side 28. At the coating station 24, a coating fluid applicator 30 laterally dispenses a stream of coating fluid 32 onto the first side 26 of the web 20. Accordingly, downstream from the coating station 24, the web 20 bears a coating 34 of the coating fluid 32.

In FIG. 1, an electrostatic coating assist for the coating process is provided by applying electrostatic charges to the first side 26 of the web 20 at a charge application station 36 spaced longitudinally upstream from the coating station 24 (the charges could alternatively be applied to the second side 28). At the charge application station 36, a laterally disposed corona discharge wire 38 applies positive (or negative) electrical charges 39 to the web 20. The wire 38 can be on either the first or second side of the web 20. The coating fluid 32 is grounded (such as by grounding the coating fluid applicator 30), and is electrostatically attracted to the charged web 20 at the coating station 24. A laterally disposed air dam 40 can be disposed adjacent and upstream of the coating station 24 to reduce web boundary layer air interference at the coating fluid web interface 41. The corona wire could be aligned in free space along the web (as shown in FIG. 1) or alternatively, could be aligned adjacent the first side of the web while the web is in contact with a backing roll at the coating station.

FIG. 2 shows another known electrostatically assisted coating system. In this arrangement, a relatively large diameter backing roll 42 supports the second side 28 of the web 20 at the coating station 24. The backing roll 42 can be a charged dielectric roll, a powered semiconductive roll, or a conductive roll. The conductive and semiconductive rolls can be charged by a high voltage power supply. With a dielectric roll, the roll can be provided with electrical charges by suitable means, such as a corona charging assembly 43. Regardless of the type of backing roll 42 or its means of being charged, its outer cylindrical surface 44 is adapted to deliver the electrical charges 39 to the second side 28 of the web 20. As shown in FIG. 2, the electrical charges 39 from the backing roll 42 are positive charges, and the coating fluid 32 is grounded by grounding the coating fluid applicator 30. Accordingly, the coating fluid 32 is electrostatically attracted to charges residing at the interface between the web 20 and the outer cylindrical surface 44 of the roll 42. The air dam 40 reduces web boundary layer air interference at the coating fluid web interface 41.

Known electrostatically assisted coating arrangements such as those shown in FIGS. 1 and 2 assist the coating process by delaying the onset of air entrainment and improving the wetting characteristics at the coating wetting line. However, they apply charges to the web at a location substantially upstream from the wetting line, and generate fairly broad electrostatic fields. They are largely ineffective in maintaining a straight wetting line when there are cross-web coating flow variations or cross-web electrostatic field variations. For instance, in a curtain coater, if a localized heavy coating fluid flow area occurs somewhere across the curtain, the wetting line in this heavier coating region can move downweb in response depending on materials or process parameters. This can create an even heavier coating in this area due to stress and strain on the curtain, especially for fluids which exhibit elastic characteristics (more elastic fluids have high extensional viscosity in relation to shear). In addition, if the electrostatic field is not uniform (e.g., there is a corona web precharge non-uniformity), the lower voltage area on the web will allow the wetting line in that area to move downweb, thus increasing the coating weight in that area. These effects become increasingly dominant as fluid elasticities increase. Thus, crossweb fluid flow variations and crossweb electrostatic field variations cause non-uniformity in the wetting line and, as a result, the application of a non-uniform coating on the web.

None of the known apparatus or methods for electrostatically assisted coating discloses a technique for applying a focused electrical field to the web at the coating station from an electrical field applicator to improve the characteristic of the applied fluid coating and also to attain improved processing conditions. There is a need for an electrostatically assisted coating technique that applies a more focused electrical field to the web at the coating station.

SUMMARY OF THE INVENTION

The invention is a method of applying a fluid coating onto a substrate. The substrate has a first surface on the first side thereof and a second surface on a second side thereof. The method includes providing relative longitudinal movement between the substrate and a fluid coating station, and forming a fluid wetting line by introducing, at an angle of from 0 degrees through 180 degrees, a stream of fluid onto the first side of the substrate along a laterally disposed fluid-web contact area at the coating station. An electrical force is created on the fluid from an effective electrical field originating from a location on the second side of the substrate that is substantially at and downstream of the fluid wetting line, without requiring electrical charges to move to the substrate while attracting the fluid to the first surface of the substrate via electrical forces.

The creating step can include electrically energizing an electrode on the second side of the substrate to form the effective electrical field from electrical charges. In one embodiment, the effective electrical field is defined by a portion of the electrode which has a radius of no more than 1.27 cm (or, in one preferred embodiment, no more than 0.63 cm).

The substrate can be supported, adjacent the fluid coating station, on the second side thereof, or can be supported by the electrode itself.

The stream of fluid can be formed with a coating fluid dispenser such as a curtain coater, a bead coater, an extrusion coater, carrier fluid coating methods, a slide coater, a knife coater, ajet coater, a notch bar, a roll coater or a fluid bearing coater. The stream of coating fluid can be tangentially introduced onto the first surface of the substrate.

The electrical charges of the electrode can have a first polarity and second electrical charges (having a second, opposite polarity) can be applied to the stream of fluid before the stream of fluid is introduced onto the substrate.

The creating step can include electrically energizing an electrode and also acoustically exciting the electrode. In one preferred embodiment, the electrode is acoustically excited at ultrasonic frequencies.

The inventive method is also defined as a method of applying a fluid coating onto a substrate, where the substrate has a first side and a second side. The inventive method includes providing relative longitudinal movement between the substrate and a fluid coating station. A stream of fluid is introduced, at an angle of 0 degrees through 180 degrees, onto the first side of the substrate to form a fluid wetting line along a laterally disposed fluid-web contact area at the coating station. The invention flirter includes attracting the fluid to the first side of the substrate at a location on the substrate that is substantially at and downstream of the fluid wetting line by electrical forces from an effective electrical field originating at a location on the second side of the substrate.

The invention is also an apparatus for applying a coating fluid onto a substrate which has a first surface on a first side thereof and a second surface on a second side thereof. The apparatus includes means for dispensing a stream of coating fluid onto the first surface of the substrate to form a fluid wetting line along a laterally disposed fluid contact area. A field applicator extending laterally across the second side of the substrate (generally opposite the fluid wetting line) bears electrical charges, and applies an effective electrical field to the substrate at a location on the substrate that is substantially at and downstream of the fluid wetting line to attract the fluid to the first surface of the substrate. The effective electrostatic field primarily emanates from electrical charges on the electrical field applicator rather than electrical charges transferred to the substrate.

The electrical field applicator can include a small diameter rod, a conductive strip, or a conductive member with a small radius portion for use in defining the effective electrical field. An air bearing can extend laterally across the substrate adjacent the electrical field applicator for supporting and aligning the second side of the substrate relative to the electrical field applicator.

In another embodiment, the invention is defined as a method of applying a fluid coating onto a substrate which has a first surface on a first side thereof and a second surface of a second side thereof. The method includes providing relative longitudinal movement between the substrate and a fluid coating station, forming a fluid wetting line by introducing, at an angle of 0 degrees through 180 degrees, a stream of fluid onto the first surface of the substrate along a laterally disposed fluid-web contact area at the coating station, exposing the coating fluid (adjacent the coating station) to an electrical force to attract the fluid to the substrate, and exposing the coating fluid (adjacent the coating station) to an acoustical force to attract the coating fluid to the substrate.

In another embodiment, the invention is an apparatus for applying a coating fluid onto a substrate having relative longitudinal movement with respect to the apparatus. The substrate has a first surface on the first side thereof and a second surface on the second side thereof. A coating fluid applicator dispenses a stream of coating fluid onto the first surface of the substrate to form a fluid wetting line along a laterally disposed fluid contact area. An electrical field applicator applies an electrostatic field at a location on the substrate adjacent the fluid wetting line to attract the coating fluid to the first surface of the substrate. An acoustical field applicator applies an acoustical field at a location on the substrate adjacent the fluid wetting line to attract the coating fluid to the first surface of the substrate.

Figure 1:
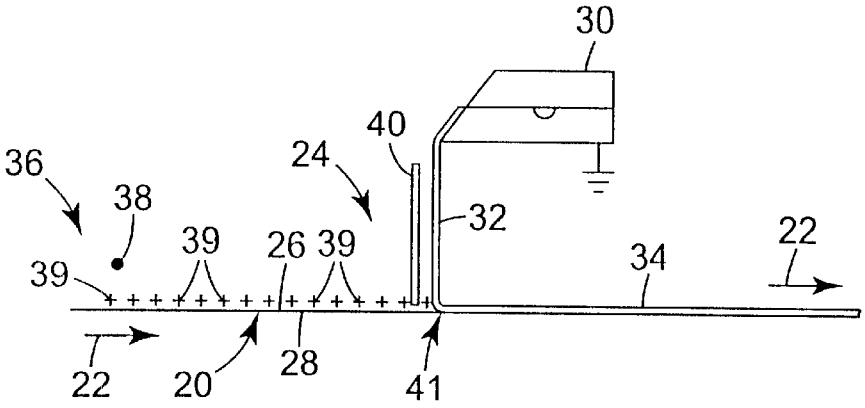
Fig. 1 PRIOR ART
FIG. 1 is a schematic view of a known electrostatic coating apparatus where charges are applied to the moving web before it enters a coating station from an upweb corona wire.

While some of the above-identified drawing figures set forth preferred embodiments of the invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention.

DETAILED DESCRIPTION OF PREFERRED EMBODIMENTS

This invention includes an apparatus and coating method which use more focused electrostatic fields at the interface between a substrate (such as a web) to be coated and a fluid coating material applied on the substrate. The inventors have found that more focused electrostatic fields can improve the coating process by stabilizing, straightening, and dictating the position of the coating wetting line, allowing wider process windows to be achieved. For example, the invention makes possible a wider range of coating weights, coating speeds, coating geometries, web features such as dielectric strengths, coating fluid characteristics such as viscosity, surface tension, and elasticity, and die-to-web gaps, as well as improving cross web coating uniformity. With curtain coating, electrostatic coating assist allows lower curtain heights (and therefore, greater curtain stability) and allows the coating of elastic solutions which could not previously be coated without entrained air. Focused fields greatly enhance the ability to run coating fluids (especially elastic fluids) since they more precisely dictate the position, linearity, and stability of the wetting line, which results in increased process stability. In addition, thinner coatings than were previously possible can be produced, even at lower line speeds, which is important for processes that are drying or curing rate limited.

With extrusion coating it has been found that electrostatics permits the use of lower elasticity waterbased fluids (such as some waterbased emulsion adhesives) that cannot be extrusion coated absent the electrostatics (in the extrusion mode), as well as permitting the use of larger coating gaps.

In curtain coating, the stream of fluid is aligned with the gravitational vector, while in extrusion coating it can be aligned with the gravitational vector or at other angles. While coating with a curtain coating process, where longer streams of fluid are used, the coating step involves the displacing of the boundary layer air with coating fluid and the major force is momentum based. In contrast, with extrusion coating, where the stream of fluid is typically shorter than for curtain coating, the major forces are elasticity and surface tension related. When using electrostatics an additional force results which can assist in displacing the boundary layer air, or can become the dominant force itself.

Although the invention is described with respect to smooth, continuous coatings, the invention also can be used while applying discontinuous coatings. For example, electrostatics can be used to help coat a substrate having a macrostructure such as voids which are filled with the coating, whether or not there is continuity between the coating in adjacent voids. In this situation, the coating uniformity and enhanced wettability tendencies are maintained both within discrete coating regions, and from region to region.

The substrate can be any surface of any material that is desired to be coated, including a web. A web can be any sheet-like material such as polyester, polypropylene, paper, knit, woven or nonwoven materials. The improved wettability of the coating is particularly useful in rough textured or porous webs, regardless of whether the pores are microscopic or macroscopic. Although the illustrated examples show a web moving past a stationary coating applicator, the web can be stationary while the coating applicator moves, or both the web and coating applicator can move relative to a fixed point.

Generically speaking, the invention relates to a method of applying a fluid coating onto a substrate such as a web and includes providing relative longitudinal movement between the web and a fluid coating station. A stream of coating fluid is introduced onto the first side of the web along a laterally disposed fluid wetting line at a coating station. The coating fluid is introduced at any angle of from 0 degrees through 180 degrees. An electrical force is created on the fluid from an effective electrical field substantially at and downstream of the fluid contact area (e.g., originating from one or more electrodes that are located on the second side of the web). Negative or positive electrical charges may be used to attract the coating fluid. The coating fluid can include solvent-based fluids, thermoplastic fluid melts, emulsions, dispersions, miscible and immiscible fluid mixtures, inorganic fluids, and 100% solid fluids. Solvent-based coating fluids include solvents that are waterbased and also organic in nature. Certain safety precautions must be taken when dealing with volatile solvents, for example that are flammable, because static discharges can create hazards, such as fires or explosions. Such precautions are known, and could include using an inert atmosphere in the region where static discharges might occur.

Instead of precharging the web or using an energized roll support system, as are known, the preferred embodiments of the invention use an electrical field source, such as narrow conductive electrode extending linearly in the cross-web direction, positioned where the fluid web contact line should occur. The narrow conductive electrode could be, for example, a small diameter rod in the range of about 0.16–2.54 cm (0.06–1.0 in), either rotating or non-rotating, a narrow conductive strip, a member with a sharply defined (small radius portion) leading edge (the wetting line will typically be located near the sharply defined leading edge), or any electrode with a geometry that presents a focused and effective electrical field to the wetting line that is substantially at and downstream of the wetting line. Generally, the smaller the radius, the more focused the field. However if the radius becomes too small, increased corona generation can occur. Rod diameters less than 0.16 cm (0.06 in) can be used as long as the applied voltage is not high enough to create significant corona discharge. If the discharge is too high, the predominant electrical force can come from corona charges that are deposited on the second surface of the web. The electrode can be supported by a small support structure such as a porous air bearing material adjacent the electrode on the upweb and downweb sides. The web can be supported by the air bearing surface, or by the electrode itself. The electrode can be closely spaced from the web or can be in physical contact with the web. The electrode can also have discrete, discontinuous crossweb support structures, or can be supported only on its ends. The electrode can also be made of a porous conductive material.

The main attractive force for this embodiment comes from the electrostatic field originating from the electrode, not from charges transferred to the backside of the web by contact or spurious corona discharge. Again, the field is focused to be effective (as an attractant for the coating fluid) substantially at or downstream of the web-fluid contact line. The electrode on the backside of the web creates a more focused electrical field than known electrostatic coating assist systems. Because the field does not extend as far upweb as in the prior art (precharged webs or energized coating rolls), the fluid is drawn to a more sharply defined wetting line, retains a more linear crossweb profile, and stabilizes the wetting line by tending to lock it into position. This means that the normal balance of forces that dictate the contact line position are less important, and that nonlinearities in the wetting line are less pronounced. Thus, process variations, such as coating flow rates, coating crossweb uniformity, web speed variations, incoming web charge variations, and other process variations have less effect on the coating process. Typically the smaller the diameter of the electrode or the more sharply defined the leading edge of the electrode structure, the more focused the leading edge of the electrostatic field and wetting line linearity will become, as long as spurious corona discharges can be kept to a minimum.

Process stability is greatly enhanced with the focused electrode field system. Typically, if an electrostatically assisted coating system is running at a particular speed, coating thickness, and voltage, changing one of these variables changes the wetting line position. For example, the wetting line will shift downweb if speed is increased, coating thickness is increased, or applied voltage is decreased, depending on the type of coating system and fluid being coated. This can cause coating uniformity problems and can increase the potential for air entrainment. The inventive focused field system greatly reduces the sensitivity of the process to those variables and maintains the wetting line at a more stable straight line position.

Figure 3:
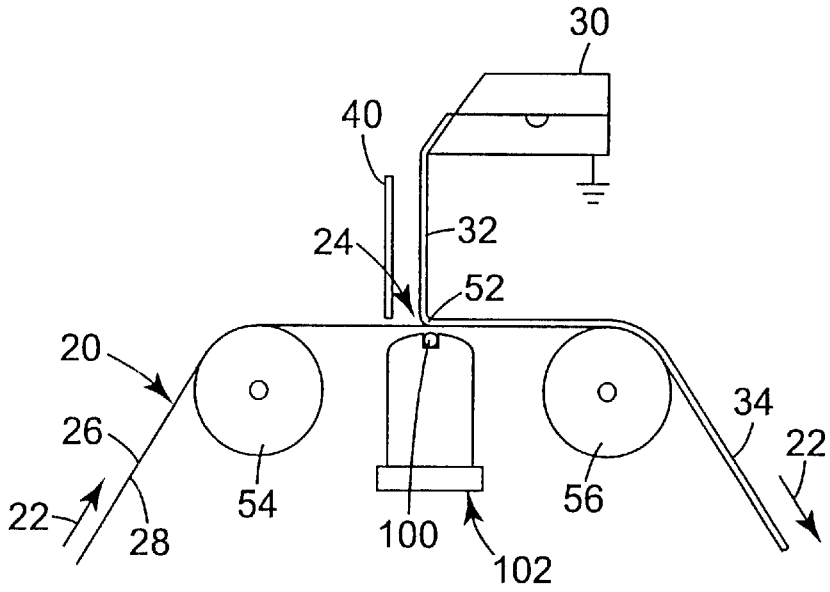
FIG. 3 is a schematic view of one embodiment of the electrostatically assisted coating apparatus of the present invention where the effective electrostatic field is defined by a lateral electrode adjacent the coating fluid wetting line in combination with an air bearing assembly.

Many configurations of the electrode can be used in practicing the invention. FIG. 3 shows an example where a laterally extending electrode 100 is supported along the second side 28 of the web 20. The laterally extending electrode 100 is uniformly and closely spaced from or may be contacting the second side 28 of the web 20, longitudinally close to the coating station 24 that includes the lateral coating fluid web contact line 52. The web 20 is supported at the coating station 24 such as between a pair of support rolls 54, 56. Alternatively, the web 20 can be supported at the coating station 24 by the electrode itself, an air bearing 102 (or any suitable gas bearing, such as an inert gas bearing), or other supports. A stream of coating fluid 32 is delivered from the coating fluid applicator 30 onto a first surface on the first side 26 of the web 20. As shown, the coating fluid applicator 30 can be grounded to ground the coating fluid 32 relative to the electrode 100. The air dam 40 can be any suitable physical barrier which limits boundary layer air interference at the coating fluid web interface or the point of coating curtain formation.

The electrode 100 may be formed, for example, from a small diameter rod or other small dimension conductive electrode (which does not necessarily need to be round). Preferably, the electrode 100 is disposed within the adjacent air bearing 102, which may or may not be in contact with the air bearing. The air bearing 102 stabilizes the web position and minimizes the web vibrations which otherwise can have an adverse effect on coating stability and uniformity. The air bearing 102 is typically radiused and preferably has a porous material 104 (such as porous polyethylene) in fluid communication with an air manifold chamber 106. Pressurized air is provided to the air manifold chamber 106 via one or more suitable inlets 108, as indicated by arrow 110. The air flows through the air manifold chamber 106 and into the porous membrane 104. The porous membrane 104 has a relatively smooth and generally radiused bearing surface 112 positioned adjacent a second surface of the web 20 on the second side 28 thereof. Air exiting the bearing surface 112 supports the web 20 as it traverses the coating station 24 and electrode 100. While an active air bearing is described, a passive air bearing (using only the air boundary layer on the second side of the web as the bearing media) can work at sufficiently high web speeds. The air bearing can also be a solid structure that acts as an air bearing as substrate speeds increase and boundary layer air on the second side of the web creates the air bearing effect. The gap between the air bearing surface and web is a function of parameters such as the radius of the air bearing, the web tension and speed of the web. Other known ways of creating an air bearing can also be used such as airfoil designs commonly used in drying.

The embodiment of the electrostatic coating assist system of FIG. 3 forms a more focused electrostatic field at the fluid-web contact area which constrains the wetting line to a more linear profile at a desired location. The embodiment "locks" the wetting line into a stable line extending laterally across the web (as compared to the less effective known electrostatic coating assist systems of FIGS. 1 and 2 which provide a less focused electrostatic attraction between the fluid and web). The electrostatic field emanating from the electrode creates the main electrostatic attractive (i.e., effective) force on the coating fluid. Electrostatic charges are not placed primarily from the electrode onto the web itself. Rather, their presence on the charged device, such as an elevated potential electrode, attracts the coating fluid. It is intended that charges not be transferred to the web from the electrode, although in practice, some inevitably will transfer and assist in the coating process.

Instead of grounding the coating fluid 32, an opposite electrical charge can be applied to the coating fluid 32 such as by a suitable electrode device. In addition, the applied polarities of the electrical charges to the coating fluid 32 and web 20 can be reversed. This method is particularly useful when using lower electrical conductivity fluids such as certain 100% polymer melts or 100% solids curable systems. For example, for a low conductivity fluid, charges can be applied to the fluid before coating, whether through the die or by a corona discharge. This system can be used when insufficient electrostatic aggressiveness is seen due to the use of low conductivity fluids. The ability of the inventive system to retain the fluid wetting line in a more linear fashion results in increased coating uniformity and stability. For a conductive fluid where the conductive path is isolated, the die potential can be raised to create the opposite polarity in the fluid. Alternatively, the opposite polarity can be applied to the fluid anywhere along the conductive, isolated path (including, for example, even downstream of the wetting line).

Figure 2:
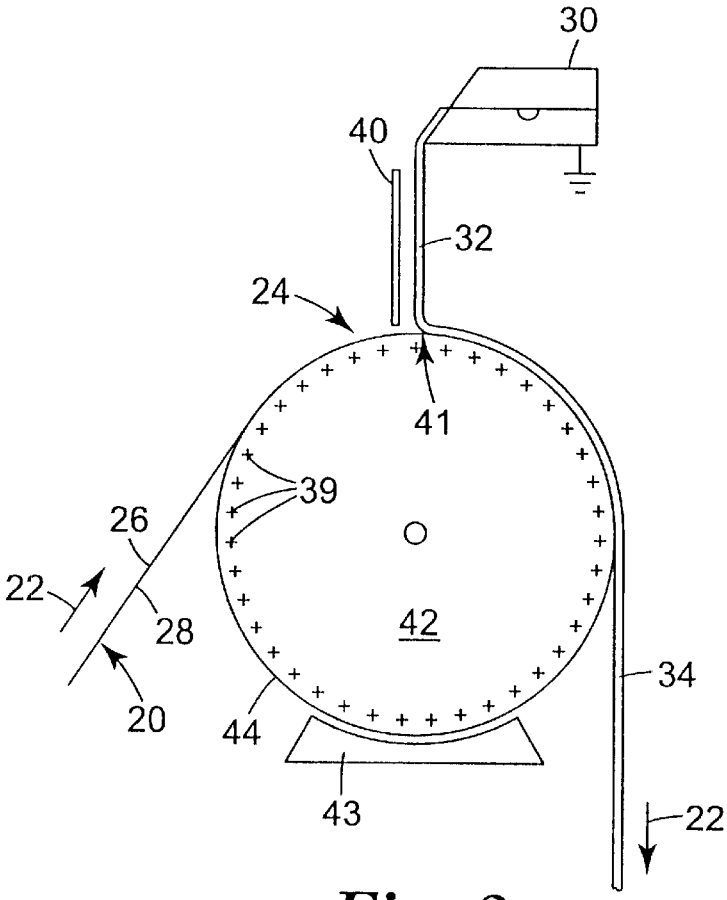
Fig. 2 PRIOR ART
FIG. 2 is a schematic view of a known electrostatic coating apparatus where charges are delivered to the moving web from a backing roll under the moving web at the coating station.
Figure 5:
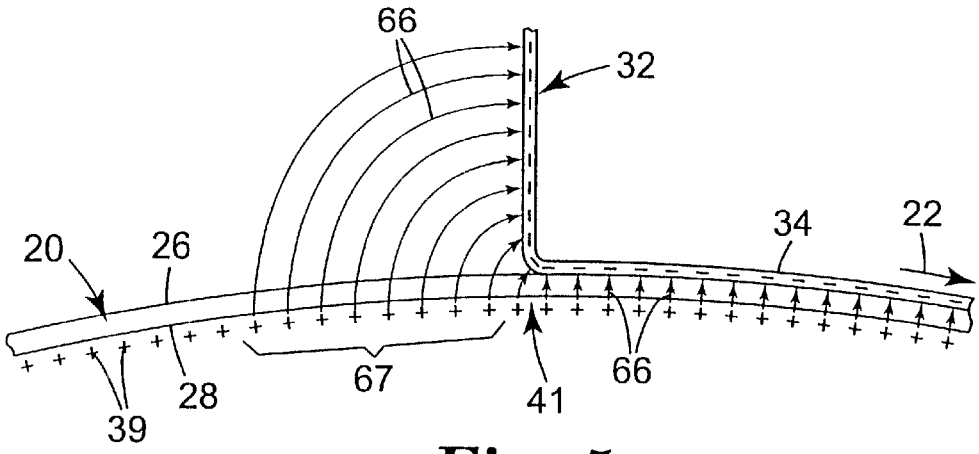
Fig. 5 PRIOR ART
FIG. 5 is an enlarged schematic view of a portion of FIG. 2 illustrating the applied electrostatic charges and lines of force.

FIG. 5 is an expanded view of the prior art system in FIG. 2, and lines of force 66 generated by the electrostatic charges relative to the coating fluid 32. For curtain coating applications, the desired wetting line is typically the gravity-determined coating fluid wetting line (with no electrostatics applied) when the web is stationary (or initial coating fluid wetting line (with no electrostatics applied) when the web is stationary) and, as illustrated in FIGS. 2 and 5, is the top dead center of the charged roll. However, other wetting line positions are common and depend on the type of coating die, fluid properties, and web path. The lines of force 66 indicate that for a charged roll (like the roll 42 in FIG. 2) the forces are not well focused and the charges are exerting forces on the coating fluid substantially upweb of the wetting line (e.g., on upweb area 67). For example, for charged rolls that are larger than 7.5 cm (3 in) in diameter, the charges exert forces on the coating fluid substantially upweb from the desired wetting line. However, as the delivery of charges to the web becomes more focused, say for a one-inch diameter roll given the same potential, the charges do not exert functional forces on the coating fluid substantially upweb from the desired wetting line that adversely affect the wetting line uniformity (i.e., the charges on the web are ineffective upweb relative to the coating fluid).

Figure 6:
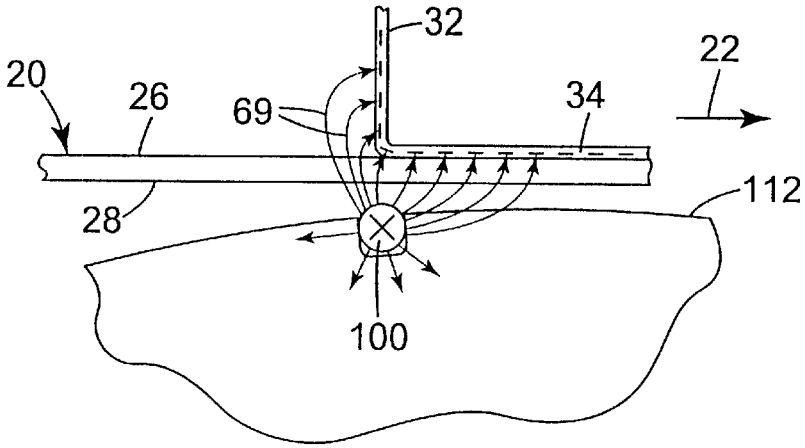
FIG. 6 is an enlarged schematic view of a portion of FIG. 3 illustrating the electrostatic lines of force of the effective electrical field.

FIG. 6 is an expanded view of the inventive system of FIG. 3, showing where the electrical field is effective as an attractant for the coating fluid, as it is more focused beneath the coating fluid contact line. In this case, the lines of force 69 are more focused, thus creating a more sharply defined and linear wetting line which stabilizes the fluid-web contact line by tending to lock it into position across the web travel path.

In an inventive electrostatic coating assist system such as illustrated in FIG. 3, the electrode 100 can be positioned directly under the laterally extending coating fluid-web contact line, which is determined by the placement (such as by gravitational fall) of the coating fluid 32 onto the web 20. Web movement, surface tension, and boundary layer effects on the first side of the web 20, and the elasticity of the coating fluid 32, can cause the coating fluid web contact line to shift downweb. Because of the strong electrostatic attraction that can be achieved with this invention, the location of the electrode 100 will determine the operational location of the wetting line when the electrode 100 is activated. Thus, the location of the electrode 100 (upstream or downstream from the initial coating fluid-web contact line) can cause a corresponding movement of the contact line, as it tends to align itself with the opposed attracted electrical charges. Preferably, the electrode 100 is positioned no more than 2.54 cm (1.0 in) upstream or downstream from the initial coating fluid-web contact line.

As mentioned above, the electrode may take many forms, but it is essential that it create an effective electrical field for highly focused attraction of the coating fluid to a desired wetting line location. This may be accomplished by forming portions of the electrode with certain specific geometries. For example, a leading edge or an edge adjacent the web may be formed to have a specifically tuned radius for creating the desired electrical force field lines. In this instance, that portion of the electrode preferably has a radius of no greater than 1.27 cm (0.5 in), and more preferably a radius of no greater than 0.63 cm (0.25 in). Other field focusing means are also possible. For instance, an additional electrode could be located adjacent the first electrode so as to modify the field from the first electrode. The second electrode may be positioned at any location, including upstream from the first electrode 100 or even on the first side 26 of the web 20, so long as its resultant electrostatic field has the desired focusing effect on the electrostatic field generated from the first electrode 100. The result of focusing the electrostatic field generated by the electrode 100 is a straighter wetting line which is less sensitive to non-uniform fluid flow or charge variations of the electrode or on the incoming web, thereby providing a more uniform coating and greater process tolerance to production variations.

It will be understood that the location of the electrode can be upstream or downstream of the fluid wetting line so long as the effective electrical field is substantially at or downstream of the fluid wetting line. For example, an electrode can be configured so that surface charge density is higher substantially at or downstream of the fluid wetting line to focus the effective electrical field substantially at or downstream of the fluid wetting line. Alternatively, the effective electrical field can be focused substantially at or downstream of the fluid wetting line by masking the upstream electrical field with a conductive or nonconductive shield or grounding plate, for example, as described in U.S. patent application Ser. No. 09/544,368, filed Apr. 6, 2000, on Electrostatically Assisted Coating Method And Apparatus With Focused Web Charge Field, by John W. Louks, Nancy J. Hiebert, Luther E. Erickson and Peter T. Benson.

Figure 4:
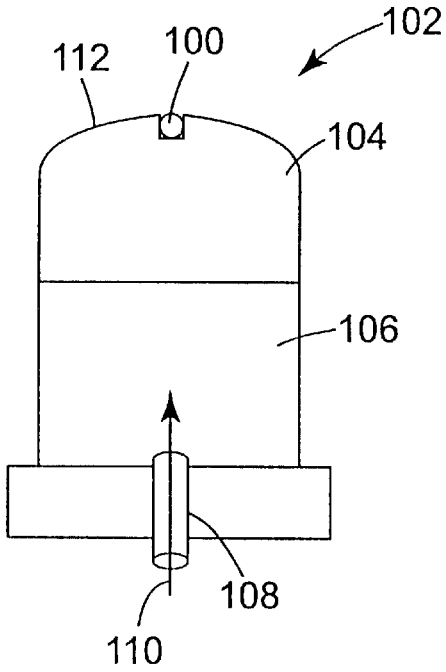
FIG. 4 is an enlarged view of the air bearing assembly with the electrode of FIG. 3.
Figure 7:
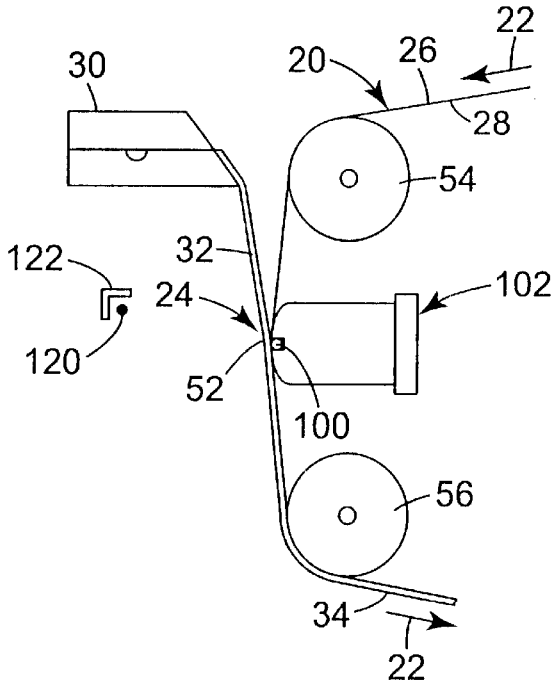
FIG. 7 is a schematic view of another embodiment of the electrostatically assisted coating apparatus of the present invention, illustrating one application of its use for tangential curtain coating.

The use of a sharply defined electrode structure adjacent the wetting line to create an effective electrical field relative to the coating fluid also lends itself well to tangential fluid coating, especially with more elastic fluids. A tangential coating apparatus using such an electrode is shown in FIG. 7 (using an air bearing/electrode assembly such as illustrated in FIG. 4). Tangential curtain coating is generally capable of running coating fluids with higher extensional viscosities than is possible with horizontal curtain coating geometries. A tangential coating geometry also offers advantages associated with the handling of the coating fluid in the coating process. For example, if a web break occurs in the coating system illustrated in FIG. 3, the electrode can become coated with coating fluid, which will result in downtime for coater cleanup. In addition, if the coating die is to be purged before start-up, a catch pan geometry must be present which can complicate the coating station structure. Another advantage from tangential coating is that curtain edge bead control during coating is more easily achieved due to the removal of space constraints between the bottom of the die or coating fluid applicator 30 and the web support structure (e.g., the air bearing 102).

Figure 8:
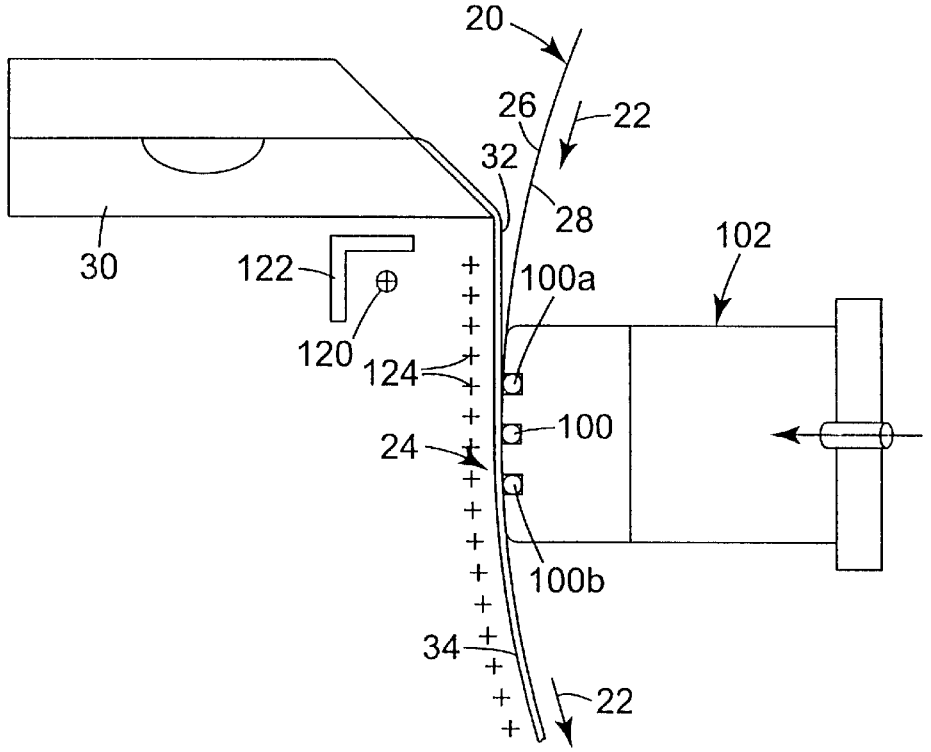
FIG. 8 is an enlarged schematic illustration of an air bearing and electrostatic field generation system with multiple electrodes.

FIG. 8 illustrates another embodiment of the air bearing assembly shown in FIG. 7. For a particular fluid an optimum curtain length exists for a particular web speed range. In general, higher speeds or higher coat weights can require longer curtains and lower speeds or lower coat weights can require shorter curtains. While in FIG. 7 only one electrode is shown, the multiple electrode assembly shown in FIG. 8 has the advantage of allowing the operator to change the curtain height by energizing the appropriate electrode. For example, a shorter curtain could be used for a thin coating or lower web speeds, while a longer curtain could be used for higher line speeds. Thus rather than moving the die down to define a shorter curtain length, the electrode 100*a* closest to the die 30 can be energized, and rather than moving the die up to define a longer curtain length, the electrode 100*b* farthest from the die 30 can be energized. The spacings of the electrodes can be selected depending on the fluid characteristics and speed ranges desired.

In all embodiments of the present invention, an effective electrical field of positive electrical charges may be exposed to the web at the coating station, while grounding the coating fluid. In addition, a negative polarity may be applied to the coating fluid. Further, it is possible to reverse the polar orientations of the electrical field and the charges applied to the coating fluid. For instance, FIG. 8 illustrates a laterally extending electrode 120 (such as a corona wire) which is aligned to apply a positive charge to the coating fluid 32. The electrode 120 may be shielded by one or more suitable laterally extending shields 122 to direct and focus its application of positive charges 124 to the coating fluid 32. In that instance, the electrode 100 on the second side 28 of the web 20 has a negative charge relative to the web 20 traversed thereby, in order to create the desired electrostatic attraction effect. The shields 122 can be formed from a nonconductive or insulating material, such as DELRIN™ acetal resin made by E. I du Pont de Nemours of Wilmington Del. or from a semiconductive or conductive material held at ground potential or an elevated potential. The shields 122 can formed in any shape to achieve the desired electrical shielding.

Figure 9:
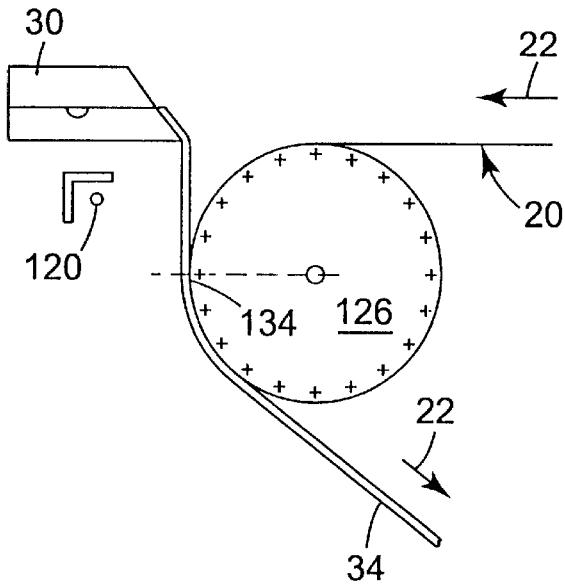
FIG. 9 is a schematic view of a tangential coating test arrangement with a prior art sized powered roll.
Figure 10:
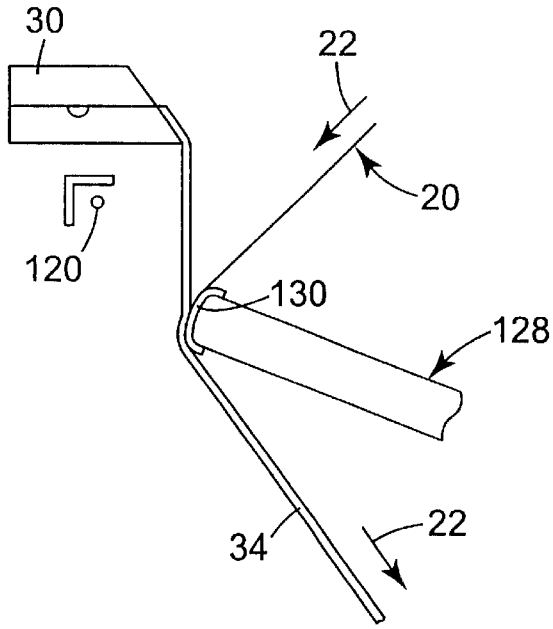
FIG. 10 is a schematic view of another embodiment of the electrostatically assisted coating apparatus of the present invention, in a generally tangential coating configuration.
Figure 11:
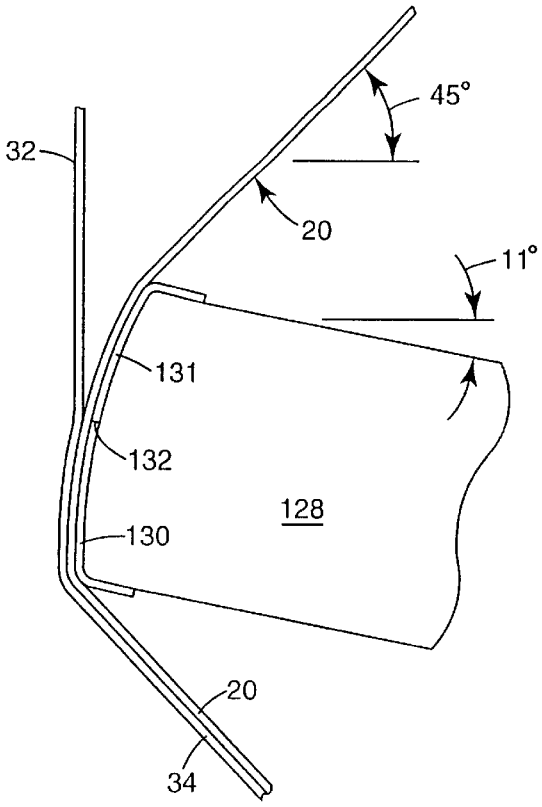
FIG. 11 is an enlarged schematic illustration of the electrode assembly of FIG. 10.

The utility of using focused fields at the fluid wetting line to achieve a more linear and stable wetting line was demonstrated in a series of experiments comparing tangential coating with a relatively large diameter charged roll (see, e.g., FIG. 9) versus an experimental focused electrode assembly (see, e.g., FIG. 10). The coating fluid was a 100% solids curable fluid having a viscosity of approximately 3,000 centipoise. A curtain length of approximately 4.45 cm (1.75 inches) was used (the curtain length being measured as the distance from the bottom of the die lip to the fluid contact line). A curtain charging corona wire was used and was about 3.18 cm (1.25 inches) vertically below the die lip and about 7.62 cm (3.0 inches) horizontally from the falling curtain. The curtain flow rate was adjusted to give a 50 micron (0.002 inch) coating thickness at a web speed of 91.4 m/min (300 ft/min). The charged roll system (FIG. 9) was a 11.3 cm (4.55 inch) diameter roll 126 with a 0.51 cm (0.2 inch) ceramic sleeve. The ceramic surface was charged by a corona wire system. The inventive focused electrode assembly (as illustrated in FIG. 11) included a nonconductive bar 128 with a 3.18 cm (1.25 inch) radius surface. A conductive foil 130 was adhered to the bar 128 with a leading edge 132 of the conductive foil 130 being about 0.25 cm (0.1 inches) above the tangent point on the bar (the tangent point being that point where the coating curtain, unaided by electrostatics, would engage the web passing over the bar 128). A nonconductive tape 131 has an edge abutting the leading edge 132 of the conductive foil 130. The focused field is created by the leading edge 132 of the foil 130. The foil 130 was charged using a negative polarity high voltage power supply. Positive and negative polarity Glassman series EH high voltage power supplies manufactured by Glassman High Voltage, Inc. of Whitehouse Station, N.J. were used for these experiments.

Using the charged roll system illustrated in FIG. 9, the curtain charging corona wire 120 was set at a negative 20 kilovolts and the roll 126 corona charger set at a positive 20 kilovolts. The wetting line typically occurred about 1.27 cm (0.5 inches) upweb of the tangent point on the roll created by a vertical line from the die lip to the roll (upweb from point 134, FIG. 9). With a web speed of 76 m/min (250 ft/min) the wetting line was wavy with a total upweb-to-downweb deviation of 1.27 cm (0.5 inches). The measured coating thickness variation related to this was about 17.9 microns (0.0007 inches). Increasing the speed to 91.4 m/min (300 ft/min) resulted in entrained air in the coating 34.

Using the focused field system, major improvements were seen in wetting line uniformity and coating uniformity. The electrode assembly of FIGS. 10 and 11 was oriented in a tangential fashion similar to that shown in FIG. 7, but with the incoming web at a more acute angle. The curtain charging corona wire 120 was set at a positive 20 kilovolts and the conductive foil 130 was set at a negative 20 kilovolts. At 91.4 m/min (300 ft/min), excellent wetting line linearity was observed with a related measured coating variation of about 3.6 microns (0.00014 inches). These experiments demonstrate the improvements in wetting line linearity and coating thickness uniformity with more focused electrostatic fields.

Two tests with the focused field setup of FIGS. 10 and 11 were performed to analyze the process sensitivity to the coating fluid input flow rate and current charging uniformity, running with a 50 micron (0.002 inch) coating thickness at a web speed of 91.4 m/min (300 ft/min). First, a lateral segment of about 0.25 cm (0.1 in) was blocked in the slot of the coating fluid applicator 30 to create a lateral low flow rate area in the coating curtain 32. Second, a lateral section 0.33 cm (0.13 in) long of the curtain charging wire (electrode 120) was covered in another area, creating a lateral area of reduced charge on the coating curtain 32. With the focused field system of bar 128 activated, no visual deflection of the coating fluid/web contact line was observed by either of the contrived lateral discontinuities. Absent the focused field, the curtain 32 in the low flow area would bow upweb and the curtain 32 in the low charge area would bow downweb, with both conditions accentuating coating nonuniformities. Accordingly, the use of the electrostatic focused field to facilitate coating is very effective in overcoming system irregularities in the coating fluid curtain.

Figure 12:
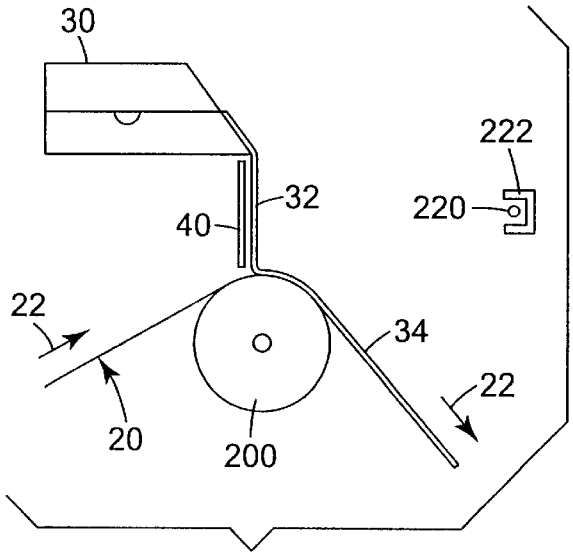
FIG. 12 is a schematic view of another embodiment of the electrostatically assisted coating apparatus of the present invention, where the effective electrostatic field is defined by a one-inch diameter backing roll.

Comparative quantitative analysis tests were also conducted to evaluate the utility of precharging the incoming fluid to increase the aggressiveness of the electrostatic system for fluids with limited electrical conductivity. In this series of tests, a 100% solids curable fluid was coated on a 0.0036 cm (0.0014 inch) polyester web. The viscosity of the fluid was approximately 1,400 centipoise. A slide curtain die set up was used such as illustrated in FIG. 12, with a conductive backing roll 200 of only 2.54 cm (1.0 inch) diameter, attached to a positive polarity high voltage power supply. The die 30 was located directly above the top dead center of the roll 200, at a height of about 2.7 cm (1.06 inches). However, it was observed that the aggressiveness of the coating method was limited by the low electrical conductivity of the coating fluid 32. To address this, the surface of the coating fluid 32 was charged to an opposite polarity of the energized backing roll 200. Two methods of doing this were investigated and seen to be functional, one being to elevate the potential of the die 30, and the other being the use of a corona wire 220 (and associated shield 222) to charge the surface of the fluid. The curtain charging was accomplished with a 0.015 cm (0.006 inch) diameter tungsten corona wire located about 6.35 cm (2.5 inches) from the falling curtain on the downweb side of the wetting line, about 1.27 cm (0.5 inches) above the roll surface. The exact location of this corona wire 220 was not extremely critical, and it could be located at different locations along the falling curtain, on the opposite side of the curtain, or adjacent the slide surface of the die 30.

This series of tests was run on the inventive electrostatic coating assist system of FIG. 12 to determine the maximum coating speed that could be attained at a given curtain flow rate (a) without electrostatics, (b) with only the roll potential elevated, and (c) with the roll potential elevated along with curtain precharging. The flow rate of the coating fluid 32 was held constant and set to yield a dry coating thickness of 14.3 microns (0.00057 inches) at 91.4 m/min (300 ft/min). With no electrostatics, the wetting line occurred 1.27 cm (0.5 inches) downweb of the top dead center of the roll 200 at a web speed of 3.1 m/min (10 ft/min). At higher web speeds, the wetting line deflected further downweb, creating a bowed contact line, coating nonuniformity, air entrainment and curtain breakage. With the backing roll 200 energized to a positive 20 kilovolts, the wetting line occurred at about 0.64 cm (0.25 inches) downweb, at a web speed of 24.4 m/min (80 ft/min). Further increases in speed resulted in the wetting line moving further downweb. With the roll 200 energized to a positive 20 kilovolts and the curtain corona charging wire 220 at a negative 11 kilovolts, the wetting line occurred at about 0.64 cm (0.25 inches) downweb at a web speed of 97.5 m/min (320 ft/min). These tests show the utility of charging lower conductivity coating fluids as a way to improve the electrostatic charge attraction aggressiveness of the inventive electrostatic coating assist system. Another set of experiments was conducted on the electrostatic coating assist system of FIG. 12 (using the same coating fluid) for the purpose of determining the minimum coating thickness that could be achieved at a web speed of 91.4 m/min (300 ft/min). With no electrostatics (i.e., no charges applied to roll 200 or electrode 220) the pumping system used was not capable of supplying sufficient coating fluid 32 to get up to the minimum flow rate necessary to cause the wetting line to occur at the top dead center position of the roll 200 (the flow rate was not high enough to create the fluid momentum necessary to cause the wetting line to occur near the top dead center of the roll 200 and the curtain to maintain a vertical position). At this pump rate, which was less than the minimum coating thickness, the wetting line occurred about one inch downweb of the top dead center position of the roll 200, yielding a coating thickness of 85 microns (0.0034 inches). Using electrostatics, with both the backing roll 200 and corona wire 220 energized as in the previous example much thinner coatings were possible, with a minimum coating thickness of 6.5 microns (0.00026 inches) being achieved with the wetting line occurring essentially at the top dead center position of the roll 200.

Since it was observed that more focused electrostatic fields produced more linear and stable coating fluid wetting lines, a tangential coating system utilizing a focused field apparatus, similar to that shown in FIG. 7 was evaluated. The electrode 100 in the air bearing assembly 102 was a 0.157 cm (0.062 inch) diameter rod. For the first experiment with this design, a 100% solids curable fluid having a viscosity of approximately 3,700 centipoise was use as a coating fluid. A two inch curtain length was used (the curtain length being measured as the distance from the bottom of the die lip to the rod). The curtain charging corona wire 120 was about 0.75 inches vertically above the rod and about 2.25 inches horizontally spaced from the rod. The rod electrode was held at a negative 16 kilovolts and the curtain corona charging wire was held at a positive 10 kilovolts. The two roll air bearing assembly was aligned to present the web 20 for contact with the coating fluid 32 at approximately a 10-degree angle from vertical. A 50 micron (0.002 in) thick coating was produced at a web speed of 250 feet per minute with a straight and stable contact line. Coating thickness variation resulting from wetting line variations was only about 2 microns (0.00008 inches). The electrostatic coating assist thus minimized process variations and enhanced coating uniformity.

Figure 13:
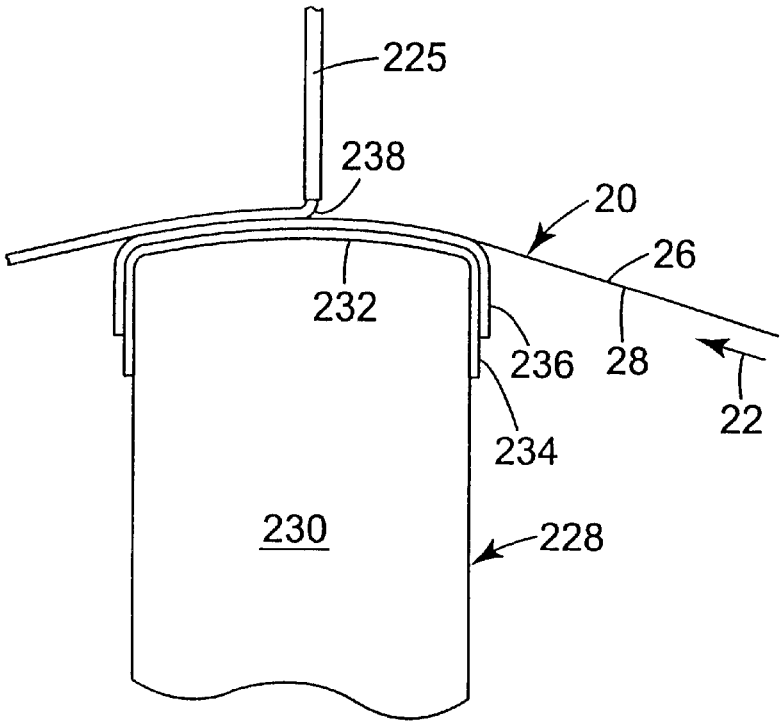
FIG. 13 is a schematic view of an inventive electrostatic field electrode which is combined with an ultrasonic horn.
Figure 14:
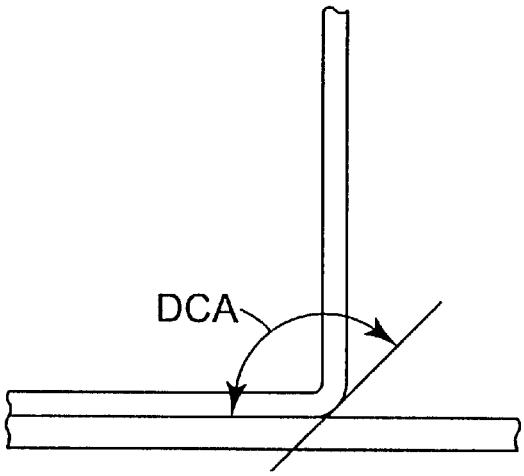
FIG. 14 illustrates the "dynamic contact angle" of fluid coating onto a web.

U.S. Pat. Nos. 5,262,193 and 5,376,402 disclose that acoustically exciting the line of initial contact between the coating fluid and the web during coating increases uniformity and wettability of the coating fluid. The inventors here have found that applying both the acoustic and electrostatic fields simultaneously have an additive effect on the desirable forces on the wetting line. For example, FIG. 13 illustrates a test conducted using a 0.076 cm (0.03 in) inner diameter hollow needle 225 as the coating die and a combined ultrasonic and electrostatic electrode 228 beneath the second side 28 of the web 20. The combined electrode consisted of an ultrasonic horn 230, having on its horn face 232 layers of nonconductive polyester tape 234 and a layer of conductive aluminum tape 236. As shown, the needle 225 was oriented perpendicular to the horn face 232 on the first side 26 of the web 20, and the horn 230 was on the second side 28 of the web 20, similar to the orientation shown in FIG. 3, with the web 20 passing over aluminum tape 236 on the horn surface 232. The needle 225 is aligned to dispense a stream of coating fluid 238 onto the first surface of the web 20 opposite the electrode 228. In fluid coating, the "dynamic contact angle" or "DCA" is a measure of the resistance of the coating system to failure due to air entrainment. Generally, the dynamic contact angle (see, FIG. 14) increases with increasing web speed until the onset of air entrainment occurs, generally near 180 degrees.

The application of ultrasonic or electrostatic forces reduces the dynamic contact angle. The ultrasonic aluminum horn was 1.91 cm (0.75 inches) wide with a 1.27 cm (0.5 inch) radius. The applied frequency was 20,000 kilohertz and the amplitude was 20 microns (0.0008 in) peak to peak. The electrostatic electrode was constructed by attaching two layers of adhesive tape (polyester 234) plus an outer layer of aluminum tape 236 which was coupled to a positive high voltage power supply. The coating fluid 238 was a glycerine and water solution having a viscosity of 100 centipoise. It was seen that at a web speed of 3 m/min (10 ft/min), the "dynamic contact angle" without electrostatics or ultrasonics was 135 degrees, while with ultrasonics alone it was reduced to 105 degrees, with electrostatics field applied alone it was reduced to 90 degrees, and with electrostatic and ultrasonic forces applied simultaneously it was reduced to 70 degrees, showing the additive effects of the two coating assist forces. As the web speed was increased to 30 m/min (100 ft/min) without ultrasonics or electrostatics, the "dynamic contact angle" increased to about 160 degrees, where air entrainment occurred. With electrostatics alone at a web speed of 30 m/min (100 ft/min) the dynamic contact angle was only 110 degrees. With ultrasonics alone, the dynamic contact angle was also only 110 degrees. With both ultrasonics and electrostatics applied, the dynamic contact angle was reduced to 100 degrees, further showing the additive effects of the two coating assist forces. To illustrate the effect of the external forces which reduce the dynamic contact angle on coating speed, at a web speed of 3 m/min (10 ft/min), the "dynamic contact angle" without electrostatics or ultrasonics was 135 degrees, while with electrostatics alone, the "dynamic contract angle" did not increase to 135 degrees until a web speed of 76 m/min (250 ft/min) was reached. The benefits of acoustically exciting can be attained at other frequencies as well, including both sonic and ultrasonic frequencies.

The benefits of combining acoustics and electrostatics in a coating environment are not limited to the specific application detailed above. The beneficial additive effects of exposing the coating fluid to electrical forces and acoustical forces adjacent the coating station will be found in many coating applications. For example, even if the electrostatic system and ultrasonic system are being used where the forces are not substantially at and down-web of the fluid line, increases in desirable effects such as reduced air entrainment and higher coating speeds can be seen. If, however, the electrostatic or ultrasonics (or both) are configured to apply the forces substantially at and downstream of the fluid contact area, further improvements can be realized. The application of both an electrostatic field and an acoustical field adjacent the fluid wetting line to attract the coating fluid to the substrate being coated results in significant advantages, and is not limited in structure or methodology to the specific electrostatic and acoustical embodiments and force applicators disclosed herein.

Also incorporated herein by reference is U.S. patent application Ser. No. 09/544,368, filed Apr. 6, 2000, on Electrostatically Assisted Coating Method And Apparatus With Focused Web Charge Field, by John W. Louks, Nancy J. Hiebert, Luther E. Erickson and Peter T. Benson.

Various changes and modifications can be made in the invention without departing from the scope or spirit of the invention. For example, any method may be used to create the focused electrode field. The electrostatic focused field can also be made to be laterally discontinuous, to coat only particular downweb stripes of the coating fluid onto the web, or can be energized to begin coating in an area and de-energized to stop coating in an area, so as to create an island of coating fluid on the web or patterns of coating fluid thereon of a desired nature. The electrostatic field can also be made to be non linear, for example by a laterally non linear electrode so as to create a non linear contact line and non uniform coating. Thus if the electrode has a downweb curvature in a particular laterally disposed area, the coating in that area can be thicker in that area as compared to adjacent areas.

All cited materials are incorporated into this disclosure by reference.

What is claimed is:

1. A method of applying a fluid coating onto a substrate, wherein the substrate has a first surface on a first side thereof and a second surface on a second side thereof, and wherein the method comprises:

providing relative longitudinal movement between the substrate and a fluid coating station;

forming a fluid wetting line by introducing, at an angle of from 0 degrees through 180 degrees, a stream of fluid onto the first surface of the substrate along a laterally disposed fluid-web contact area at the coating station; and creating a main attractive electrical force on the fluid from an effective electrical field originating from a location on the second side of the substrate that is substantially at and downstream of the fluid wetting line in order to attract the fluid to the first surface of the substrate, wherein electrical charges which may reside on the second surface of the substrate do not constitute the main attractive electrical force.

2. The method of claim 1 wherein the creating step further comprises:

electrically energizing an electrode on the second side of the substrate to form the effective electrical field.

3. The method of claim 2 further comprising the step of locating the electrode substantially at or downstream of the fluid wetting line.

4. The method of claim 2 wherein the effective electrical field is defined by a portion of the electrode having a radius no greater than 1.27 cm.

5. The method of claim 2 wherein the effective electrical field is defined by a portion of the electrode having a radius of no greater than 0.63 cm.

6. The method of claim 1, and further comprising:

supporting the second side of the substrate adjacent the fluid coating station.

7. The method of claim 1, and further comprising:

forming the stream of fluid with a coating fluid dispenser selected from the group consisting of a curtain coater, carrier fluid coating methods, a bead coater, an extrusion coater, a slide coater, a knife coater, a jet coater, a notch bar, a roll coater, and a fluid bearing coater.

8. The method of claim 1 wherein the introducing step further comprises:

tangentially introducing the stream of fluid onto the first surface of the substrate.

9. The method of claim 2 wherein energizing the electrode creates electrode electrical charges which have a first polarity, and further comprising:

applying second electrical charges to the stream of fluid, the second charges having and opposite polarity relative to the electrode charges.

10. The method of claim 1 wherein the creating step comprises electrically energizing an electrode, and further comprising:

acoustically exciting the electrode.

11. The method of claim 10 wherein the acoustically exciting step comprises exciting the electrode at ultrasonic frequencies.

12. A method of applying a fluid coating onto a substrate, wherein the substrate has a first surface on a first side thereof and a second surface on a second side thereof, and wherein the method comprises:

providing relative longitudinal movement between the substrate and a fluid coating station;

forming a fluid wetting line by introducing, at an angle of from 0 degrees through 180 degrees, a stream of fluid onto the first surface of the substrate along a laterally disposed fluid-web contact area at the coating station;

exposing the coating fluid, adjacent the coating station, to an electrical force; and exposing the coating fluid, adjacent the coating station, to an acoustical force.

13. The method of claim 12 wherein an effect of the electrical force and the acoustical force is to attract the coating fluid to the substrate.

14. The method of claim 12 wherein the electrical force and the acoustical force originate from a common source.

15. The method of claim 12 wherein the acoustical force is an ultrasonic acoustical force.

16. The method of claim 12, and further comprising:

electrically energizing an electrode on the second side of the substrate to form the electrical force and create electrode electrical charges which have a first polarity; and applying second electrical charges, having a second, opposite polarity to the stream of coating fluid.

* * * * *

UNITED STATES PATENT AND TRADEMARK OFFICE

CERTIFICATE OF CORRECTION

PATENT NO. : 6,368,675 B1
DATED : April 9, 2002
INVENTOR(S) : Louks, John W.

It is certified that error appears in the above-identified patent and that said Letters Patent is hereby corrected as shown below:

Column 1,
Line 36, delete "Teclmology," and insert in place thereof -- Technology, --.

Column 4,
Line 47, delete "flirter" and insert in place thereof -- further --.

Signed and Sealed this

Twenty-fifth Day of March, 2003

JAMES E. ROGAN
*Director of the United States Patent and Trademark Office*